United States Patent [19]

Yoda et al.

[11] Patent Number: 4,913,086

[45] Date of Patent: Apr. 3, 1990

[54] DEVELOPING APPARATUS

[75] Inventors: Akira Yoda; Yoshimitsu Sato, both of Kanagawa, Japan

[73] Assignee: Fuji Photo Film Co., Ltd., Kanagawa, Japan

[21] Appl. No.: 290,939

[22] Filed: Dec. 28, 1988

[30] Foreign Application Priority Data

Dec. 28, 1987 [JP] Japan ..... 62-335051

[51] Int. Cl.[4] ..... G03G 15/10

[52] U.S. Cl. ..... 118/647; 355/265; 355/246; 355/261; 355/256; 118/662

[58] Field of Search ..... 118/647–650, 118/659, 660, 662; 355/256, 261, 265, 246

[56] References Cited

U.S. PATENT DOCUMENTS

| | | | |
|---|---|---|---|
| 3,820,890 | 6/1974 | Kuehnle | 355/256 |
| 3,936,854 | 2/1976 | Smith | 355/256 X |
| 3,964,436 | 6/1976 | Plumadore | 118/662 X |
| 3,964,828 | 6/1976 | Yamada et al. | 355/256 X |
| 4,006,986 | 2/1977 | Kuehnle | 355/256 X |
| 4,141,647 | 2/1979 | Lempke et al. | 355/256 |
| 4,160,593 | 7/1979 | Rosenburgh | 355/256 X |
| 4,435,071 | 3/1984 | Kuehnle | 355/256 X |
| 4,595,276 | 6/1986 | Plumadore | 118/659 X |
| 4,600,291 | 7/1986 | Ohtsuka et al. | 355/256 |
| 4,613,226 | 9/1986 | Kimura et al. | 355/256 X |
| 4,622,915 | 11/1986 | Ohtsuka et al. | 118/662 X |
| 4,623,240 | 11/1986 | Kimura et al. | 118/659 X |
| 4,727,393 | 2/1988 | Ohtsuka et al. | 355/256 |
| 4,760,425 | 7/1988 | Okano et al. | 355/256 |
| 4,797,644 | 1/1989 | Takahashi | 118/662 X |
| 4,809,642 | 3/1989 | Kimura et al. | 118/662 |

*Primary Examiner*—R. L. Moses

*Attorney, Agent, or Firm*—Sughrue, Mion, Zinn, MacPeak & Seas

[57] ABSTRACT

A developing apparatus for bringing a film into contact with a frame portion which defines a developing chamber in such a manner that a surface of the film formed an electrostatic latent image is opposed to a developing electrode disposed in the developing chamber, and for developing the film under a liquid developer supplied to the developing chamber while applying a bias voltage to the developing electrode. The developing apparatus interrupts the application of the bias voltage to the developing electrode at the time of the contact. Consequently, discharge between the film and the developing electrode can be prevented at the time of the contact.

16 Claims, 7 Drawing Sheets

DEVELOPING APPARATUS

BACKGROUND OF THE INVENTION

1. Field of the Invention:

The present invention relates to a developing apparatus for developing a film which has an electrostatic latent image, under a liquid developer in a developing chamber while applying a bias voltage.

2. Description of the Related Art:

Electrophotographic apparatuses of the type which is capable of recording an image on a predetermined frame of an electrophotographic film and projecting or copying the recorded image are known.

Further, process heads disposed in an electrophotographic apparatus for performing charging/exposure and development have been proposed, for instance in the U.S. Pat. Nos. 4,600,291 and 4,697,912.

Such the process head disclosed in either of the above-described applications includes a charging/exposure section, a developing section, a drying section and a fixing section which are aligned in that order in the direction in which an electrophotographic film is fed at a pitch equivalent to the one at which frames of the electrophotographic film are disposed.

In the above-described developing section, negatively charged toner particles contained in a liquid developer adhere to the positively charged portion of the electrophotographic film, by which an electrostatic latent image is made visible. At this time, a bias voltage is applied to a developing electrode which is disposed in the developing section and which forms a developing chamber so as to prevent the image from fogging. Further, the distance between the developing electrode and the electrophotographic film is set to a small value in order to reduce the amount of liquid developer which is applied per frame.

However, when the electrophotographic film is brought into contact with the developing section, it may vibrate, causing a discharge between the electrophotographic film and the developing electrode to which the bias voltage is applied. Accordingly, there are problems that the discharge breaks the electrostatic latent image formed on the electrophotographic film in correspondence to the image pattern of a document, an image of good quality cannot be consequently provided.

SUMMARY OF THE INVENTION

In view of the above-described problems, an object of the present invention is to provide a developing apparatus which can eliminate a discharge which occurs between a film and a developing electrode when the film is brought into contact with a developing chamber so as to provide an excellent image.

To this end, the present invention provides a developing apparatus for bringing a film which is formed an electrostatic latent image into contact with a frame portion which defines a developing chamber and opposing the film to a developing electrode provided in the developing chamber, and for developing the film by supplying a liquid developer to the developing chamber while applying a bias voltage to the developing electrode. The developing apparatus comprises an application means for applying the bias voltage to the developing electrode; and an interrupting means for interrupting the application of the voltage to the developing electrode at a predetermined time interval while contacting the film with the frame portion.

In the present invention, when the film is contacted with the frame portion, such application of a bias voltage to a developing electrode is interrupted by the interrupting means at a predetermined time, and the application is restarted after vibrations of the film has been damped. Generally, this contact is conducted by a pressing plate. The film is pressed against a developing chamber by the pressing plate in such a way that it closes the developing chamber. Thereafter, a liquid developer is supplied to the developing chamber. However, since vibrations of the film stop at this stage, a discharge does not occur due to unexpectedly narrowing a gap between the film and the developing electrode. As a result, the electrostatic latent image on the film does not break, and an image of good quality thereof can be obtained is made.

DESCRIPTION OF THE PREFERRED EMBODIMENTS

Figure 2:
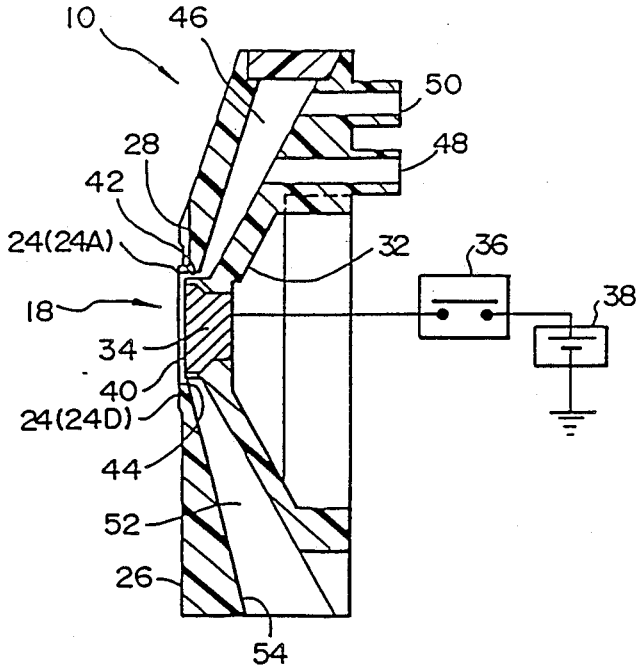
FIG. 2 is a perspective view of the process head.

FIG. 2 shows an example of a microfilm image forming process head 10 to which the present invention is applied.

As shown in FIG. 2, the process head 10 includes a relatively flat body portion 12 having a substantially rectangular parallelopiped form and a pair of leg portions 13 located at the lower portion of the body portion 12. The body portion 12 and the leg portions 13 are formed from a synthetic resin as one unit with the exception of an attachment.

The body portion 12 of the process head 10 incorporates a charging/exposure section 14, a developing section 16, a drying section 18 and a fixing section 20, which are aligned in the lateral direction of the process head 10 in that order at a fixed pitch equivalent to the interval at which frames of an electrophotographic film are disposed adjacent to each other, as shown in FIG. 2.

The charging/exposure section 14 involves the charging of the portion of the electrophotographic film 22 which is located at this section (which corresponds to one frame thereof), and an exposure of the film to radiation which has been modulated in response to the image of a document which follows the charging. These processes form on the electrophotographic film an electrostatic latent image which corresponds to the image pattern on a document. In the developing section 16, a liquid developer is coated on the electrophotographic film 22 which has been exposed to radiation in the charging/exposure section 14 so as to make the electrostatic latent image visible. The drying section 18 removes the water content by blowing dried air onto the electrophotographic film 22 which has been wet with liquid developer. The fixing section 20 fixes the image on the electrophotographic film 22 by a fixing lamp or the like.

Figure 1:
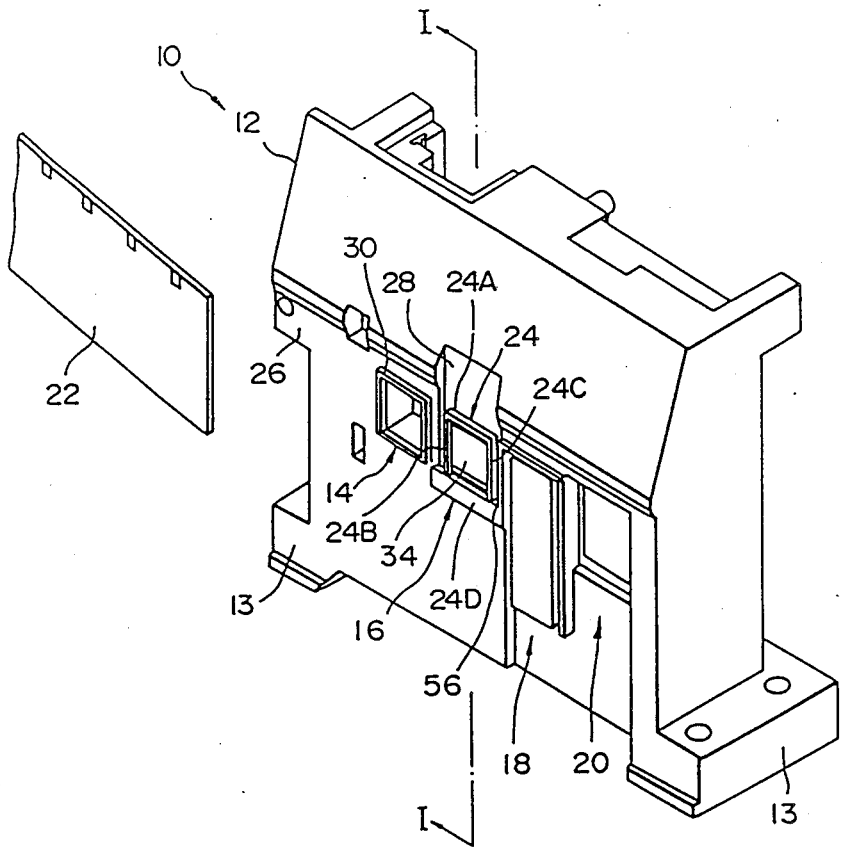
FIG. 1 is a sectional view taken along the line I—I of FIG. 2, showing a process head of the present invention.

The developing section 16 is provided with a mask 16, as shown in FIGS. 1 and 2. The mask 24 is made up from an upper frame 24A and right and left frames 24B and 24C which protrude from the surface of a recess 28 formed in a front wall 26, and a lower frame 24D which protrudes from the front wall 26. The lower frame 24D extends in two directions further from the portions thereof at which it is connected to the right and left frames 24B and 24C. The protruding height of the mask 24 is the same as that of a mask 30 formed in the charging/exposure section 14.

The opening of the mask 24 has a width slightly smaller than that of the mask 30. The height of the opening of the mask 24, i.e., the distance between the inner wall of the upper frame 24A and that of the lower frame 24D, is longer than that of the mask 30 by a value equivalent to that by which the inner wall of the lower frame 24D is located at a lower position than the inner wall of the mask 30.

A developing electrode 34 is supported by a rear wall 32 within the opening of the mask 24, as shown in FIG. 1. The developing electrode 34 is connected to a bias power source 38 through a contact 36 of a relay which acts as a voltage application interrupting means. The relay contact 36 is of the normally closed type through which a bias voltage is applied to the developing electrode 34 when the coil of a relay is not energized. When the contact 36 is opened by the energization of the coil of the relay, application of a bias voltage is interrupted. The contact 36 of the relay and the bias power source 38 are connected to a control circuit 35. The control circuit 35 includes a CPU 41, a RAM 43, a ROM 45, an inport port 37, and an output port 39 which are respectively connected by a data bus 47, as shown in FIG. 3.

The developing electrode 34 is located within the opening of the mask 24 in such a manner that the surface thereof is slightly separated inwardly from the end surface of the mask 24. A space defined by the developing electrode 34 and the inner walls of the mask 24 form a developing chamber 40. Above and below the developing electrode 34 are formed openings which act as a liquid developer/squeezing air inlet 42 and a liquid developer/squeezing air outlet 44.

The liquid developer/squeezing air inlet 42 communicates with a duct 46 which is an inner cavity of the process head 10. The duct 46 in turn communicates with a liquid developer supply port 48 and a squeezing air supply port 50, which are opened in the back surface of the process head 10. Further, the liquid developer/squeezing air outlet 44 communicates with a duct 52 which is an inner cavity of the process head 10. The duct 52 communicates with a liquid developer/squeezing air discharge port 54 which is opened in the lower surface of the process head 10.

Figure 3:
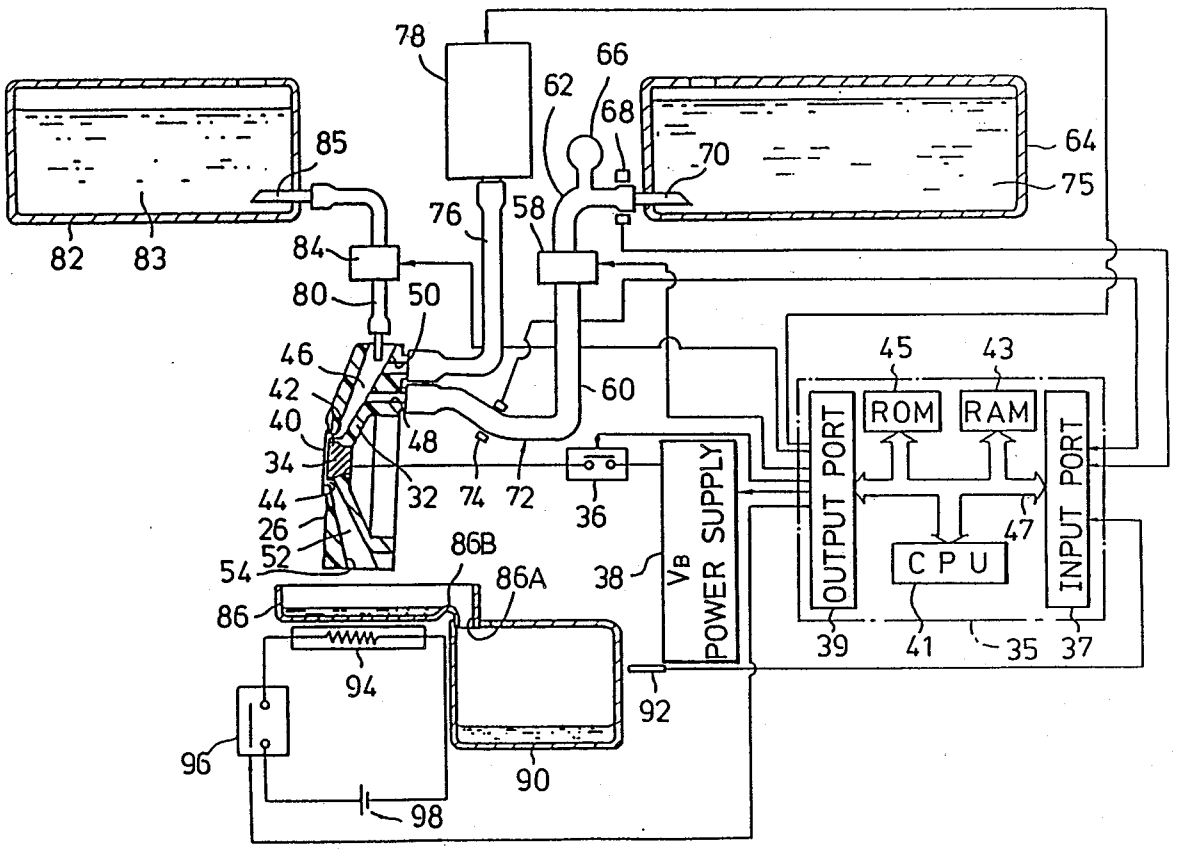
FIG. 3 is an explanatory view showing a relationship between a developing section of the process head and another components.

As shown in FIG. 3, the liquid developer supply port 48 is connected to a liquid developing tank 64 through conduits 60 and 62 via an electromagnetic valve 58 interposed therebetween. The liquid developer tank 64 is located above the electromagnetic valve 58. A needle 70 which is provided at the forward end of the conduit 62 is inserted into the liquid developer tank 64 through the lower portion of its side wall so as to communicate the conduit 62 with the liquid developer tank 64. A pipe of a diameter ranging between 0.8 mm and 1.5 mm is used as the conduits 60 and 62.

The conduit 62 is equipped with a known air collector 66 for collecting and removing bubbles such as that used in a pipe for a drip injection, and a first liquid detector 68 which is located between the liquid developer tank 64 and the air collector 66. The first liquid detector 68 has the function of detecting a liquid developer 75 in the liquid developer tank 64 by detecting toner particles contained in the liquid developer 75 in the conduit 62. The first liquid detector 68 is connected to the input port 37 of the control circuit 35. The first liquid detector 68 is of an optical light-transmitting type.

The conduit 60 is connected to the electromagnetic valve 58 at one end thereof. The conduit 60 extends from the electromagnetic valve downward, is bent substantially at a right angle so as to run substantially in the horizontal direction, and is then coupled to the liquid developer supply port 48 at the other end thereof.

The portion of the conduit 60 between the bent portion and the liquid developer supply port 48 which is lower than the liquid developer supply port 48 forms a portion 72 that contains the remaining of a liquid developer.

Between the liquid developer remainder-holding portion 72 and the liquid developer supply port 48 is disposed a second liquid detector 74 which detects the flow of toner particles contained in the liquid developer 75 that flows through the conduit 60, i.e., which detects the flow of the liquid developer 75 within the conduit 60. The second liquid detector 74 is connected to the input port 37 of the control circuit 35. The second liquid detector 74 is also of the optical light-transmission type.

The squeezing air supply port 50 is connected through a conduit 76 to an air pump 78 for supplying pressurized air.

The duct 46 communicates with a rinsing liquid bottle 82 through a conduit 80 which passes through the upper surface of the body section 12. An electromagnetic valve 84 is provided in the conduit 80. The electromagnetic valve 84 is connected to the output port 39 of the control circuit 35. A needle 85 which is provided at the forward end of the conduit 80 is inserted into the rinsing liquid bottle 82 through the side wall thereof in the same manner as that of the needle 70. The rinsing liquid bottle 82 accommodates a rinsing liquid 83 which may be a solvent of the liquid developer, Isoper (manufactured by Esso, K.K.).

Below the liquid developer/squeezing air discharge port 54 is disposed a waste receiver 86. The waste receiver 86 has a recovering port 86 at the bottom thereof. Part of the portion of the receiver 86 which surrounds the port 86 is bent inwardly, i.e., in the direction in which the receiver 86 shallows, to form a protruding portion 86B. An excess liquid developer which is discharged from the liquid developer/squeezing air discharge port 54 is accommodated in the bottom portion extending between the protruding portion 86B and one of the side walls.

Below the recovering port 86A is provided a recovery tank 90. An excess liquid developer which overflows the waste receiver 86 over the protruding portion 86B and which is discharged from the recovering port 86A is recovered in the recovery tank 90. A level detector 92 is disposed outside the recovery tank 90. The level detector 92 is connected to the input port 37 of the control circuit 35. It is adapted to detect the level of the liquid developer recovered in the recovery tank 90 and to send a detection signal to the control circuit 35. The level detector 92 is of the optical reflection type.

A heater 94 is provided below the waste receiver 86. The heater 94 is connected to a power source 98 via a contact 96 of a relay, which is connected to the output port 39 of the control circuit 35.

Figure 4:
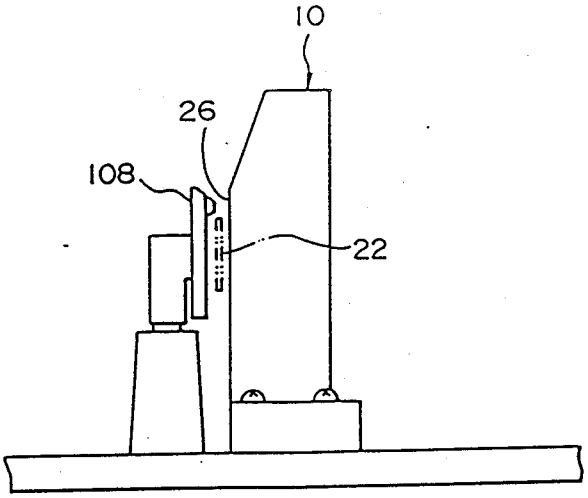
FIG. 4 is a front view showing a relationship between the process head and a pressing plate.

As shown in FIG. 4, a pressing plate 108 is disposed in front of the front wall 26 of the process head 10. The pressing plate 108 is operated by a film pressing mechanism (not shown) to press the electrophotographic film 22 against the front wall 26 of the process head 10. The individual frames of the electrophotographic film 22 which are pressed are sequentially brought into contact with the charging/exposure section 14, the developing section 16, the drying section 18, and the fixing section 20.

Next, the operation of this embodiment will be described below.

The individual frames of the electrophotographic film 22 are successively fed to the charging/exposure section 14, the developing section 16, the drying section 18 and the fixing section 20 which are disposed in the process head 10 adjacent to each other in that order, and are processed to record images on the electrophotographic film 22.

In that case, a film moving motor (not shown) is driven and one frame selected from the frames which carry no images is located in front of the mask 30 of the charging/exposure section 14. This operation is conducted by specifying a predetermined frame using a control keyboard (not shown) for operating the electrophotographic apparatus which incorporates the process head 10.

Now, recording of an image on this predetermined frame which is achieved by feeding it to the charging-/exposure section 14, the developing section 16, the drying section 18 and the fixing section 20 successively will be described below with reference to FIGS. 5. 6(A) and 6(8).

A predetermined frame which is selected from the frames which carry no images is located at the charging/exposure section 14, and this predetermined frame is charged and exposed to radiation so as to form an electrostatic latent image thereon. As to whether or not this charging/exposure has been completed is determined in step 200. If the answer is negative, this determination is repeated until the charging/exposure is completed.

After the charging/exposure has been completed and an electrostatic latent image has been formed on the electrophotographic film, the pressing of the film by the pressing plate 108 is released, and a film moving motor (not shown) is operated (in Steps 202 and 204) so as to move the predetermined frame on which an electrostatic latent image has been formed away from the charging/exposure section 14. Subsequently, in Step 206 it is determined whether or not the predetermined frame is brought to and located at the developing section 16. At this time, the determination as to whether or not the predetermined frame has been located at the developing section 16 is made on the basis of the distance through which the electrophotographic film 22 moves, which is obtained by counting the number of bliping marks (not shown) formed on the electrophotographic film 22 at fixed intervals. The operation of the film moving motor is continued until the predetermined frame is located at the developing section 16. When it is located at the developing section 16, the film moving motor is stopped (in step 208).

Figure 5:
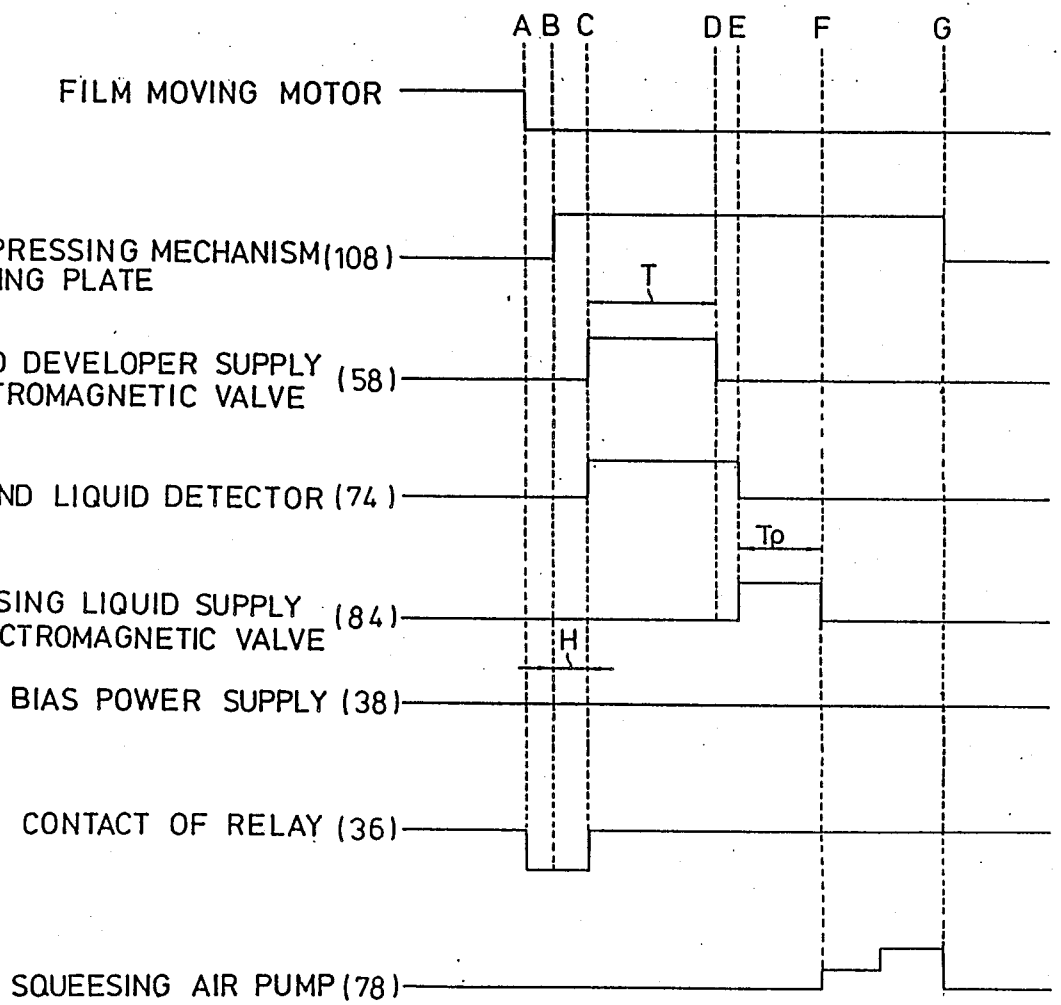
FIG. 5 is a graph showing a timing at which application of a voltage to a developing voltage is temporarily interrupted as well as an operation timings of another components.
Figure 6:
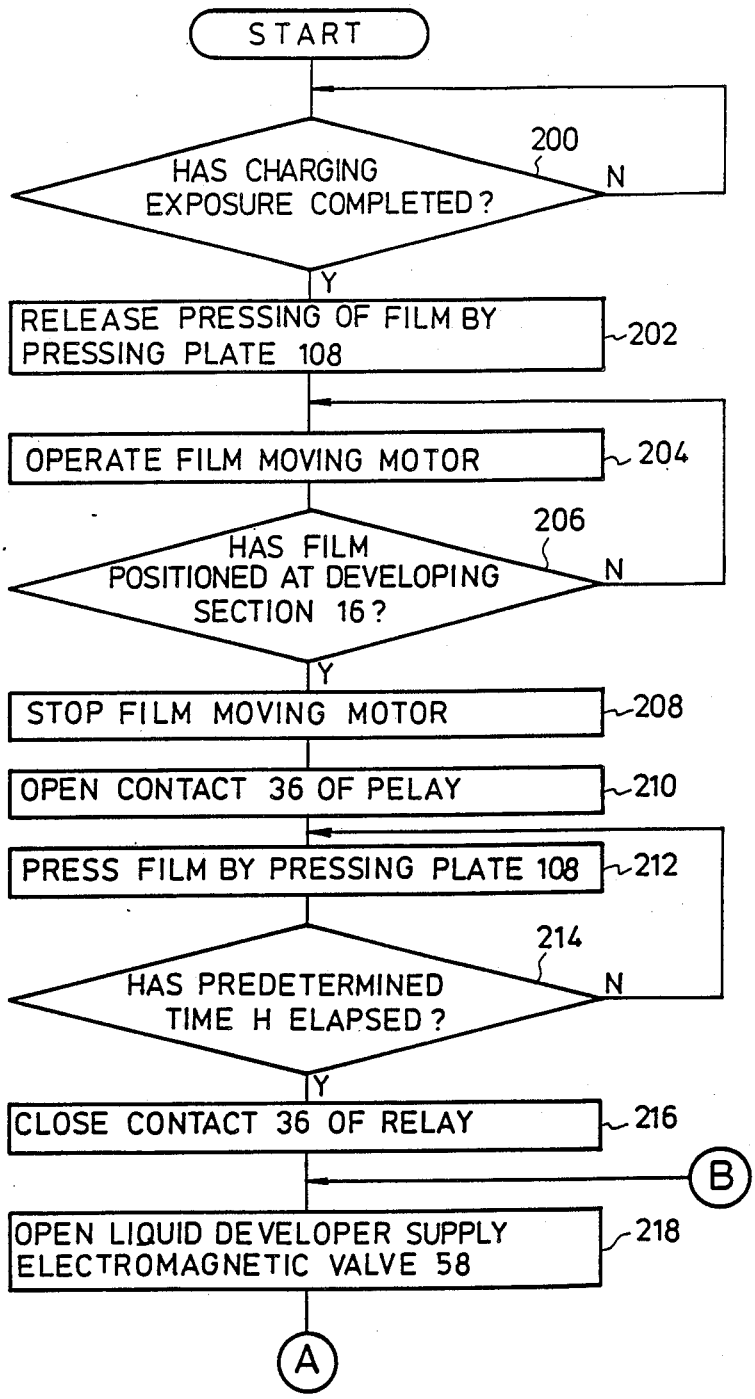
FIG. 6(A) and 6(B) are flowcharts of an operation of the developing section.
Figure 6:
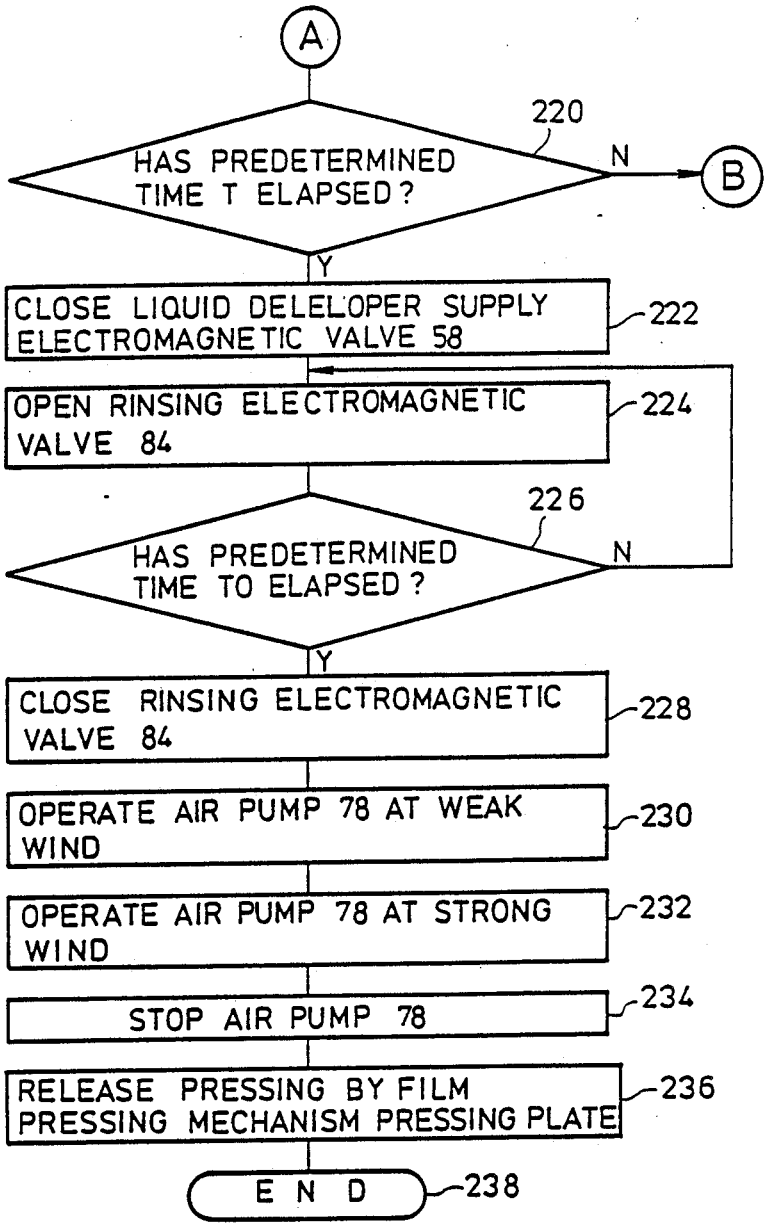

Prior to the operation of the pressing plate 108, when the film moving motor is stopped, the contact 36 of a relay is opened so as to stop the application of a bias voltage to the developing electrode 34 (in Step 210), as shown in FIG. 5. Thereafter, the pressing plate 108 is operated at a point indicated by B in FIG. 5, and the electrophotographic film 22 is pressed against the developing chamber 40 (in Step 212). The time H during which the application of a bias voltage is stopped is about 30 msec. It is considered that vibrations of the electrophotographic film 22 which occur when the film is pressed against the mask 24 of the process head 10 by the pressing plate 108 are damped during this time H. Thus, the electrophotographic film 22 does not come too close to the developing electrode during the application of the bias voltage to the developing electrode, and occurrence of a discharge between the developing electrode 34 and the electrophotographic film 22 is thereby prevented. The contact 36 of the relay is kept open until a predetermined time H elapses. When the predetermined time H has elapsed, the relay is closed at a point indicated by C in FIG. 5 (in Step 216) and a bias voltage is applied again to the developing electrode 34.

After the electrophotographic film 22 has been pressed against the developing chamber 40, the liquid developer supplying electromagnetic valve 58 is opened for a predetermined time T (in Steps 218 and 220). As the electromagnetic valve 58 opens, the liquid developer 75 in the liquid developer tank 64 flows downward through the conduits 60 and 62. After reaching the process head 10, the liquid developer 75 flows into the developing chamber 40 from the liquid developer/-squeezing air inlet 42.

In the case of an initial development, since no liquid developer exists in the conduit 60 and the liquid developer remainder-holding portion 72, it s necessary for the electromagnetic valve 58 to be opened for a longer period to fill the conduit 60 and the liquid developer remainder-holding portion 72 with the liquid developer. The liquid developer remainder-holding portion 72 is equipped with the photoelectric type second liquid detector 74 which detects the liquid developer in the conduit 60. In the initial development, the electromagnetic valve 58 is closed a predetermined time T after the second liquid detector 74 has detected the liquid developer so as to prevent insufficient development caused by the delay of the liquid developer from occurring. The negatively charged toner particles contained in the liquid developer 75 which has been supplied adhere to the positively charged portions of the electrophotographic film 22, by which the electrostatic latent image is made visible. An excess liquid developer 75 flows downward in the developing chamber 40, enters the duct 52 from the liquid developer/squeezing air outlet 44, and is discharged into the waste receiver 86 from the liquid developer/squeezing air discharge port 54.

The excess liquid developer 75 which has been discharged into the waste receiver 86 is heated by the heater 94 so as to allow the solvent thereof to evaporate. If the amount of excess liquid developer 75 discharged into the waste receiver 86 is large, i.e., if the development is performed frequently, or if the amount of liquid developer which evaporates is small due to a lower temperature of air, the waste receiver 86 may not be able to accommodate all the excess liquid developer. In that case, the liquid developer 75 overflows the protruding portion 86B and is recovered in the recovery tank 90 from the recovering port 86A. However, overflow rarely occurs in a normal operation (except when the temperature of air is particularly low).

After a predetermined time T has elapsed following the opening of the electromagnetic valve 58, the electromagnetic valve 58 is closed in Step 222 (at a point indicated by D in FIG. 5).

After the electromagnetic valve 58 has been closed (at a point indicated by D in FIG. 5), the rinsing electromagnetic valve 84 is opened for a predetermined time To (between points E and F in FIG. 5) in Steps 224 and 226, and the rinsing liquid 83 in the rinsing liquid bottle 82 is thereby supplied to the developing chamber 40 so as to flush the excess liquid developer adhered in the developing chamber 40. The excess liquid developer which is flushed is discharged into the waste receiver 86 together with the rinsing liquid 83. The rinsing liquid 83 and the excess liquid developer discharged into the waste receiver 86 are heated by the heater 94 so as to allow them to evaporate.

When a predetermined time To has elapsed following the opening of the rinsing electromagnetic valve 84, the valve 84 is closed (in Step 228). Concurrently with the closing of the valve 84 (at a point indicated by F in FIG. 5), the squeezing air pump 78 shown in FIG. 3 is operated so as to supply pressurized air to the developing chamber 40 from the squeezing air supply port 50 (in Steps 230 and 232). An excess of the liquid developer 75 attached to the electrophotographic film 22 is thereby blown off and the liquid developer 75 which is blown off is discharged into the waste receiver 86.

A weak wind of pressurized air is supplied to the developing chamber 40 while the amount of excess liquid developer remaining in the developing chamber 40 is large (in Step 230), preventing degradation of the image caused by the blowing of air at high speed. When a predetermined time has elapsed following the start of ventilation, a weak wind changes into a strong wind. After the operation of the air pump 78 is stopped (in Step 234) and supply of the pressurized air is thus stopped, the pressing of the film by the pressing plate 108 is released (in Step 236), thereby completing development conducted in the developing section 16 (in Step 238).

Subsequently, the electrophotographic film 22 is moved by a distance equivalent to the width of one frame by the drive of the film moving motor, so that the predetermined frame which has been located at the developing section 16 is positioned at the drying section 18. After a predetermined time has elapsed following the stop of the operation of the film moving motor, a warm air is blown into the drying section 18 so as to dry the liquid developer 75.

Thereafter, the film moving motor is driven again, and the frame which has been located at the drying section 18 is moved to the fixing section 20. After the drive of the film moving motor has been stopped, a cool air is supplied to the fixing section 20.

After a predetermined time has elapsed following the operation of the film pressing mechanism, a xenon lamp (not shown) is illuminated so as to fix the toner particles onto the surface of the electrophotographic film 22, thereby completing a fixing process.

Recording of an image on the electrophotographic film 22 is completed by the completion of this fixing process.

At the time when all the processes has been completed, the conduits 62 and 60 that extend between the liquid developer tank 64 and the liquid developer supply port 48 and the liquid developer remainder-holding portion 72 are filled with the liquid developer.

If the liquid developer stays in the conduit for a long time, the toner particles diffused in the liquid developer settle, making the concentration of the toner non-uniform.

Therefore, after all the processes has been completed, the liquid developer that remains in the liquid developer supply port 48, the conduits 60 and 62 and the liquid developer remainer-holding portion 72 is returned to the liquid developer tank 64 utilizing the air pressure of the air pump 78. This is achieved by pressing the pressing plate 108 against the front surface of the process head 10, by operating the air pump 78, and then by opening the electromagnetic valve 58 for 2 or 3 seconds. After this operation has been completed, the electromagnetic valve is closed, the air pump 78 is stopped, and the pressing by the pressing plate 108 is released.

It is known that the liquid developer settles less in the liquid developer tank 64. Settlement of the liquid developer in the liquid developer tank can be completely prevented by the provision of any stirring means (not shown).

The liquid developer that has not returned remains within the conduits. However, in the present embodiment, the lowest portion of the conduits forms the liquid developer remainder-holding portion 72, and the remainder of the liquid developer stays in this liquid developer remainder-holding portion 72. The liquid developer remainder-holding portion 72 is connected to the liquid developer supply port 48 through a small pipe having a diameter ranging between 0.8 mm and 1.5 mm, and this prevents the liquid developer which remains in this remainder-holding portion from evaporating, eliminating the possibility of the piping clogging because of dried liquid developer.

In this embodiment, the contact 36 of a relay is provided as a voltage application interrupting means, and application of a bias voltage is temporarily stopped when the electrophotographic film 22 is brought into contact with the developing chamber 40. In consequence, the distance between the electrophotographic film 22 and the developing electrode 22 is made smaller than that in the conventional process head and small enough not to cause a discharge to occur (between 0.15 mm and 0.2 mm), and the amount of liquid developer supplied per frame can be reduced.

As will be understood from the foregoing description, in the present invention, a developing apparatus for bringing a film which carries an electrostatic latent image into contact with a developing chamber and for developing the film by supplying a liquid developer to this developing chamber while applying a bias voltage to a developing electrode provided in the developing chamber includes a voltage application interrupting means for temporarily interrupting the application of a voltage to the developing electrode when the film makes contact with the developing chamber. In consequence, it is possible to provide an excellent image without generating a discharge between the film and the developing electrode when the film is pressed against the developing chamber.

What is claimed is:

1. A developing apparatus for bringing a film formed an electrostatic latent image into contact with a frame portion defining a developing chamber and opposing said film to a developing electrode provided in said developing chamber, and for developing said film under a liquid developer supplied to said developing chamber while applying a bias voltage to said developing electrode, said developing apparatus comprising:

an application means for applying said bias voltage to said developing electrode; and an interrupting means for interrupting the application of said voltage to said developing electrode at a predetermined time interval while contacting said film with said frame portion.

2. A developing apparatus according to claim 1, further including a contact means for bringing said film into contact with said frames.

3. A developing apparatus according to claim 2, further including a liquid developer supply means for supplying the liquid developer to said developing chamber.

4. A developing apparatus according to claim 3, further including a control means for controlling said application means, and for applying said bias voltage to said developing electrode, and for subsequently interrupting said application of said bias voltage by controlling said interrupting means.

5. A developing apparatus according to claim 1, wherein said application means comprises a power source, and said interrupting means comprises a relay disposed between said power source and said developing electrode.

6. A developing apparatus for bringing a film formed an electrostatic latent image into contact with the periphery of a developing chamber formed in a concave shape in such a manner that a first surface of said film formed said electrostatic latent image being opposed to a developing electrode disposed at the bottom of said developing chamber, and for developing said film under a liquid developer supplied to said developing chamber while applying a bias voltage to said developing electrode, said developing apparatus comprising:

a power source for applying said bias voltage to said developing electrode; and a voltage application interrupting means for interrupting application of said voltage to said developing electrode for a predetermined time at the time of said contact.

7. A developing apparatus according to claim 6, further including a pressing means for pressing said film from a second surface of said film opposite to said first surface and making it into contact.

8. A developing apparatus according to claim 7, further including a liquid developer supply means for supplying the liquid developer to said developing chamber.

9. A developing apparatus according to claim 8, further including a liquid developer removing means for removing from said developing chamber excess liquid developer remained in said developing chamber after accomplishment of development.

10. A developing apparatus according to claim 9, further including a control means for controlling said power source and making it apply said bias voltage to said developing electrode and for controlling said voltage application interrupting means and making it interrupt said application of said voltage.

11. A developing apparatus according to claim 10, wherein said voltage application interrupting means comprises a relay disposed between said power source and said developing electrode.

12. A developing apparatus for bringing an electrophotographic film formed an electrostatic latent image into contact with a substantially rectangular frame portion of a developing chamber having an developing electrode at the bottom thereof and opposing said electrostatic latent image to said developing electrode, and for developing said film under a liquid developer containing toner particles supplied to said developing chamber while applying a bias voltage to said developing electrode, comprising:

a power source for applying said bias voltage to said developing electrode;

a pressing plate for pressing said electrophotographic film to said frame portion and making it into contact with said frame portion; and a voltage application interrupting means for interrupting application of said voltage to said developing electrode at a predetermined time during contact of said film with said frame portion.

13. A developing apparatus according to claim 12, further including a liquid developer supply means for supplying the liquid developer to said developing chamber.

14. A developing apparatus according to claim 13, further including a control means for controlling said power source, and for applying said bias voltage to said developing electrode, and for subsequently interrupting said application of said bias voltage by controlling said interrupting means.

15. A developing apparatus according to claim 14, wherein said voltage application interrupting means comprises a relay disposed between said power source and said developing electrode.

16. A developing apparatus according to claim 15, further including a liquid developer removing means for removing from said developing chamber excess liquid developer remained in said developing chamber after accomplishment of development.

* * * * *